US005402915A

United States Patent [19]

Hogan

[11] Patent Number: 5,402,915

[45] Date of Patent: Apr. 4, 1995

[54] BOTTOM DRAINING BIN-TYPE, BULK FLUID CONTAINER WITH INSERT

[75] Inventor: Christopher T. Hogan, Houston, Tex.

[73] Assignee: Kaneka Texas Corporation, Houston, Tex.

[21] Appl. No.: 159,722

[22] Filed: Nov. 30, 1993

[51] Int. Cl.[6] ..... B65D 35/36

[52] U.S. Cl. ..... 222/105; 222/185; 222/460

[58] Field of Search ..... 222/105, 183, 185, 460, 222/461

[56] References Cited

U.S. PATENT DOCUMENTS

| | | | |
|---|---|---|---|
| 2,556,661 | 6/1951 | Rendall et al. | 229/221 |
| 2,831,610 | 4/1958 | Dennie | 222/105 |
| 2,973,119 | 2/1961 | Parker | 220/464 |
| 3,081,003 | 3/1963 | Baxter et al. | 222/105 |
| 3,172,570 | 3/1965 | Lipschutz | 220/465 |
| 3,325,058 | 6/1967 | West, Jr. | 222/183 |
| 3,785,534 | 1/1974 | Smith | 222/460 |
| 4,120,420 | 10/1978 | Dirksing | 220/416 |
| 4,342,405 | 8/1982 | Croley | 222/105 |
| 4,397,406 | 8/1983 | Croley | 222/105 |
| 4,548,351 | 10/1985 | Gusic | 206/586 |
| 4,836,418 | 6/1989 | Dinslage | 222/82 |
| 5,282,550 | 2/1994 | Coleman | 222/105 |

FOREIGN PATENT DOCUMENTS

| | | |
|---|---|---|
| 2163741 | 3/1973 | Germany . |
| WO91/16246 | 10/1991 | WIPO . |

OTHER PUBLICATIONS

"It Pays to be Compatible," *Packaging Digest,* Jun., 1992.

Clement & Wellner, "Plastic Lined Fiber Bins Replace Metal/Plastic Drums," *Food Processing,* Apr., 1988.

Mans, "Showcase: Aseptic Packaging," *Prepared Foods,* Mar., 1988.

Henderson, "More Choices in Bulk Liquid Containers," *CPI Purchasing,* Dec., 1986.

Brochures, Plas-weld, Inc. of Ontario, Canada, 1989.

Brochure, MacMillan Bloedel Bulk Packaging, Marietta, Ga. 1989.

Brochure, Arena Products, Inc., Rochester, N.Y., 1991.

Article, "Corrugated Shipper Cuts Waste," *Food and Drug Packaging,* Jan. 1993.

Brochure, Boise Cascade of Louisville, Ky., 1989.

Brochure, MacMillan Bloedel Bulk Packaging, Marietta, Ga., 1991.

Brochure, LinPac, Inc., Atlanta, Ga., 1992.

Brochure, Longview Fibre Co., Portland, Oreg., 1988.

*Primary Examiner*—Andres Kashnikow

*Assistant Examiner*—Philippe Derakshani

*Attorney, Agent, or Firm*—Richard G. Lione; Michael P. Chu

[57] ABSTRACT

An improvement in a bin-type, bulk fluid container. The container comprises a rigid carton containing a plastic bag. The bag has an evacuation element in its bottom. The bag rests on an insert in the carton. The insert comprises a body molded in one piece from relatively dense, expanded plastic. The insert includes an upper panel supported by walls and partitions between the walls. The upper panel has an aperture through it for the evacuation element and forms a generally funnel-shaped surface inclined downwardly to the aperture.

6 Claims, 4 Drawing Sheets

BOTTOM DRAINING BIN-TYPE, BULK FLUID CONTAINER WITH INSERT

FIELD OF THE INVENTION

This invention relates to bin-type, bulk fluid containers. It relates particularly to a bin-type bulk fluid container with an evacuation orifice at the bottom of the bin.

BACKGROUND OF THE INVENTION

Bin-Type bulk liquid containers are generally used for the storage and transportation of large quantities of liquids. The containers comprise a rigid carton, usually constructed of corrugated cardboard or other lightweight fiber or paper materials, and are manufactured in standard sizes: 55 gallon, 110 gallon, 220 gallon, 275 gallon, 300 gallon, and 330 gallon capacities. The dimensions of the containers allow for mounting on standard-sized, rectangular loading pallets. These bulk containers offer substantial economic advantages over traditional metal drums or barrels because the bulk containers weigh less and are made from recyclable materials. Furthermore, the containers are manufactured in interlocking geometric sizes and shapes which simplify storage and minimize wasted storage space. For instance, intermediate size bulk containers may be stacked several units high. These advantages lead to lower freight rates, manufacturing ease, ease of operation, lower overall costs, and substantial space savings.

A bulk container for storing or transporting liquids also conventionally comprises a polyethylene bag placed within the rigid carton to hold the liquid product. The bag normally has a spigot, valve, or sealed tube molded into it to permit evacuation of the liquid from the filled bag. When the bag is positioned inside the carton, this evacuation element projects through a small opening or orifice in the side of the carton, near the bottom.

The carton effectively causes the liquid-filled polyethylene bag to conform to the shape of the carton. The bag is susceptible to rupture during transport, however, due to inertial movement or "splashing" of the liquid within the bag. The hydraulic energy of the liquid during movement sometimes causes the bag to stretch and crack. This problem is more significant when the bag is filled with liquids that are not too viscous.

The polyethylene bag is subject to increased stretching and an increased possibility of rupture if an air space is left between the filled bag and the top of the carton. The fluid transport and storage industry deals with this problem by filling this air space with dunnage to absorb some of the hydraulic energy of the liquid. The dunnage used is lightweight and compressible, and prevents the fluid-filled bag from shifting significantly during transportation. The most commonly used dunnage products are sealed-air foam, which is foamed into the headspace at the time the bag is filled with liquid, or 1.6 to 2.3 density foam sheeting cut to fit the space.

As previously pointed out, an evacuation element in the form of a spigot, valve or tube is used to drain liquid from the container. The element is connected to the polyethylene bag within the carton, and is sometimes positioned on the bottom of the bag. In such bottom emptying bags, the evacuation element may be centered or slightly off-center from the bottom of the bag. It protrudes through an opening formed in the bottom of the carton containing it.

The container conventionally rests on a specifically designed dispensing pallet. The pallet includes a platform on which the carton is supported. The platform has an opening formed through it in alignment with the opening in the bottom of the carton. The evacuation element is accessible through this opening. The contents of the container are removed by attaching a drain tube to this evacuation element through the pallet platform from one of its sides.

Even with this bottom emptying container which has been described, complete product evacuation cannot be achieved in an economical time period if the liquid is at all viscous. If the liquid is quite viscous, a substantial amount of it remains effectively pooled in the bottom of the bag surrounding the evacuation element, i.e., it will not gravity flow to and through the evacuation element. This effect may be magnified by the construction of the valve, which normally has an annular sealing ring protruding upwardly inside the bag to at least some slight extent.

The container may be tipped in order to cause the liquid which remains in the bag to flow. However, even then the liquid frequently merely flows past the valve. Moving the container in this fashion is inconvenient to the user, especially when the container is of a larger size. Moreover, tipping the container forward is nearly impossible if containers are stacked several high. Unstacking them to drain them reduces the economic advantage offered by this storage configuration, i.e., adds to the otherwise low costs which are a significant advantage of bulk containers. Finally, if all the liquid product in the bag is not drained, the user incurs a substantial amount of waste. In the larger bulk container sizes, 10 to 20 gallons of liquid may remain in the bottom of the bag.

BRIEF SUMMARY OF THE INVENTION

It is an object of the present invention to provide an improvement in a bin-type, bulk fluid container which assures thorough evacuation of fluid from the container.

It is another object to provide an improvement in a bin-type, bulk fluid container which protects against flex cracking of the polyethylene bag during transportation of the filled container.

It is another object to provide an improvement in a bin-type, bulk fluid container which includes a lightweight insert in the bottom of the container.

It is still another object to provide an improvement in a bin-type, bulk fluid container including an inexpensive and easily disposable, or recyclable, insert.

The invention is embodied in a bin-type, bulk fluid container comprising a carton containing a fluid tight, plastic bag. Supporting the bag within the carton is an insert which rests on the floor of the carton. The insert has a plan configuration corresponding to the inside shape of the carton. This plan configuration is conventionally square or octagonal.

The insert is generally funnel-shaped. In a preferred form it has a bag support surface made up of four surface sections. The four surface sections form a composite bag support surface which slopes downwardly from each of the outer edges of the insert, which are between 125 and 175 mm high, to a central point in the middle of, or slightly off-center from, the insert, which is 45 mm high. A drain well is formed through the insert at this point.

The insert is molded in one piece from relatively dense polypropylene in the preferred embodiment described. It includes an upper panel on which the support surface is formed. The upper panel is supported by walls at its periphery, and a series of partitions extending parallel to each other between the walls.

BRIEF DESCRIPTION OF THE DRAWINGS

The invention, including its construction and method of operation, is illustrated more or less diagrammatically in the drawings, in which.

DETAILED DESCRIPTION OF THE PREFERRED EMBODIMENTS

Figure 2:
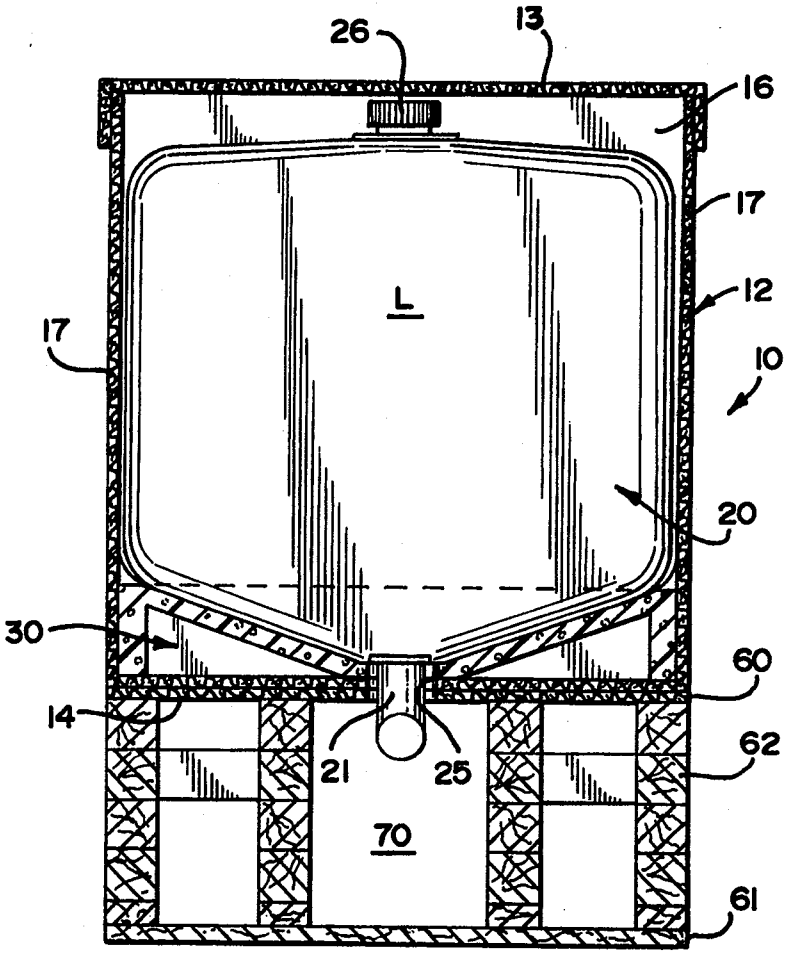
FIG. 2 is a vertical sectional view taken along line 2—2 of FIG. 1.
Figure 1:
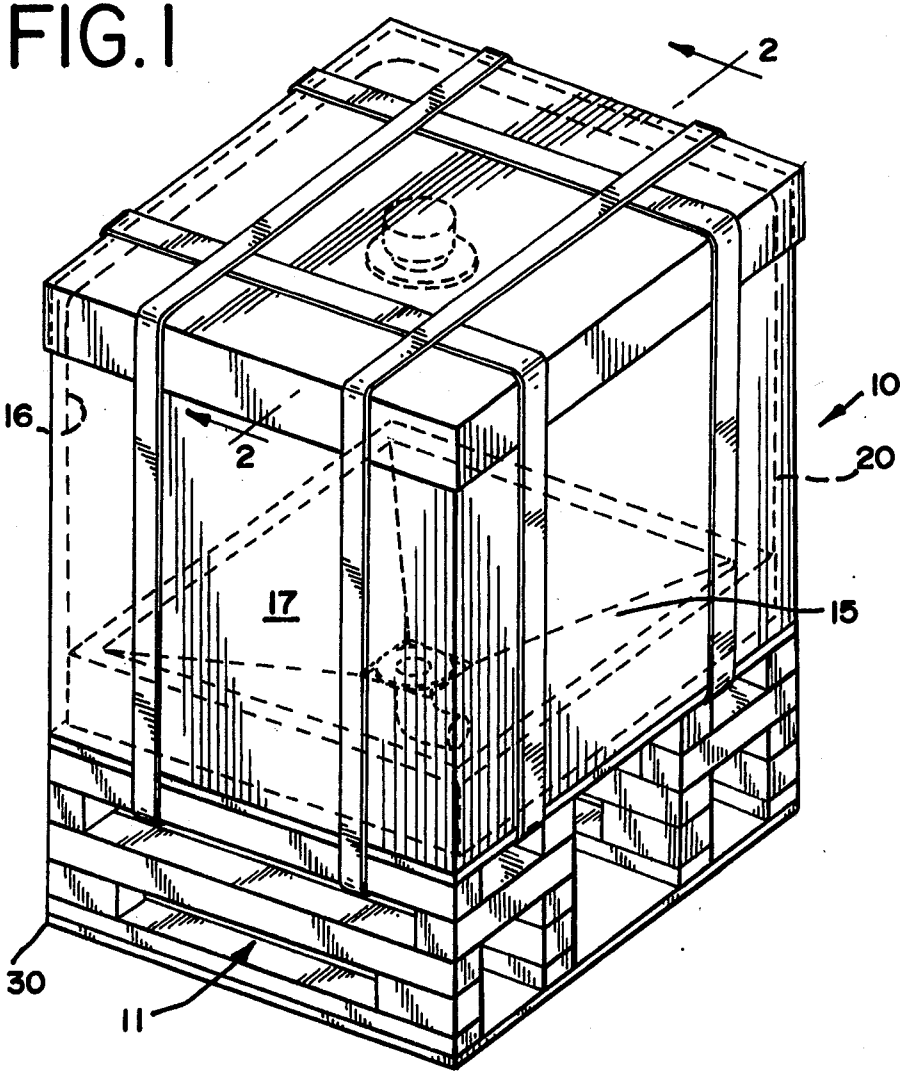
FIG. 1 is a perspective view of a first form of the improved bulk fluid container embodying features of the present invention, with some components shown in phantom lines.
Figure 3:
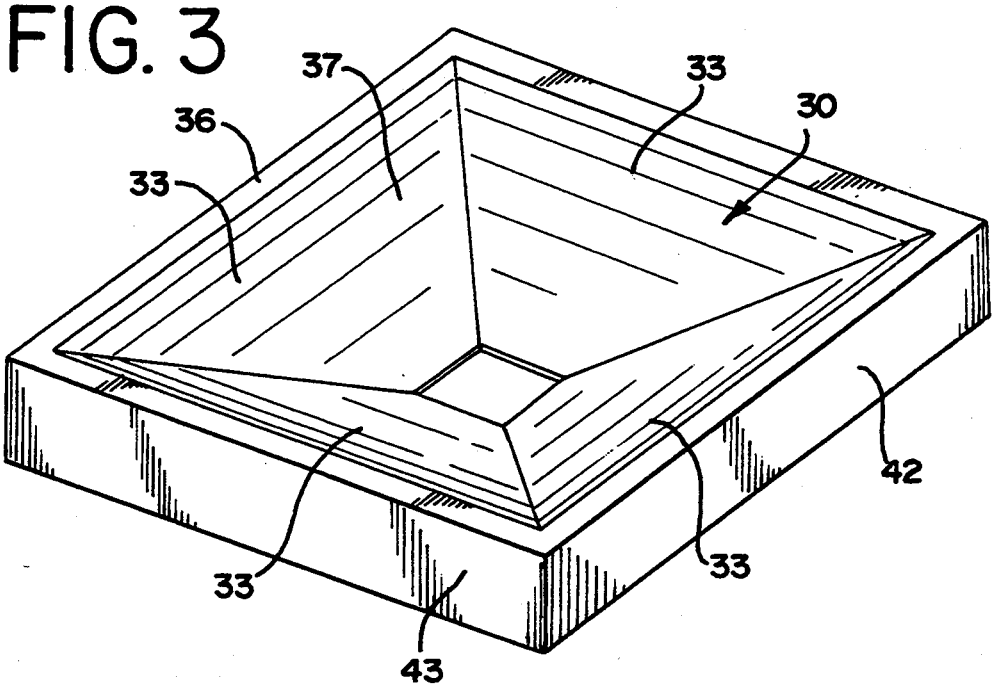
FIG. 3 is a perspective view of the insert in the improved bulk fluid container illustrated in FIGS. 1 and 2.
Figure 4:
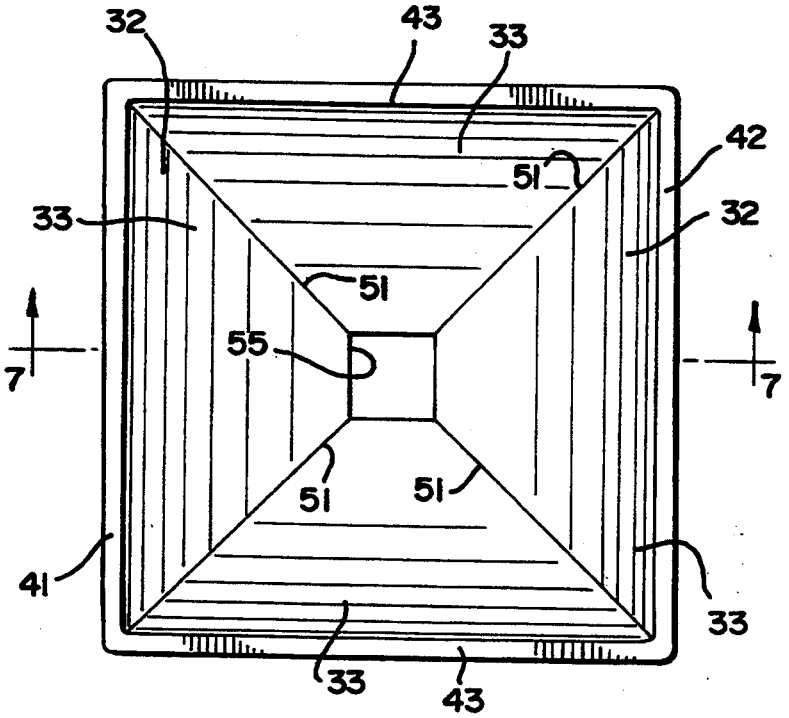
FIG. 4 is a top plan view of the insert of FIG. 3.
Figure 5:
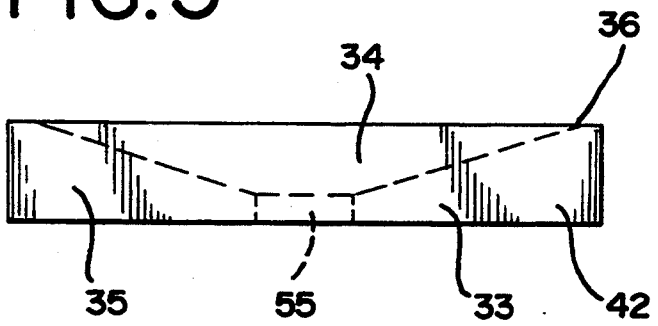
FIG. 5 is a side elevational view of the insert of FIG. 3.
Figure 6:
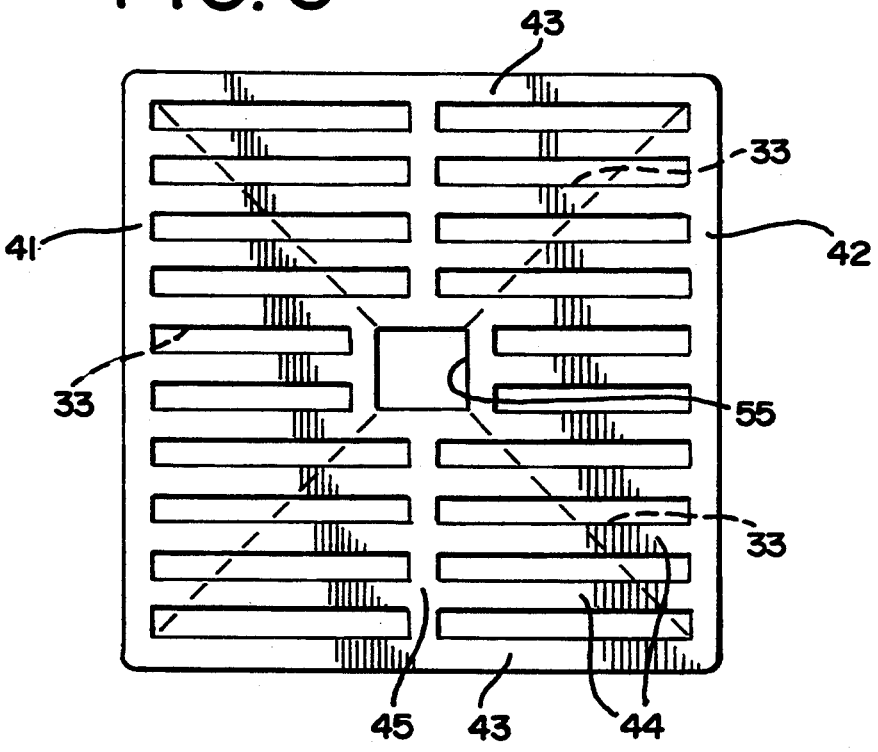
FIG. 6 is a bottom plan view of the insert of FIG. 3.
Figure 7:
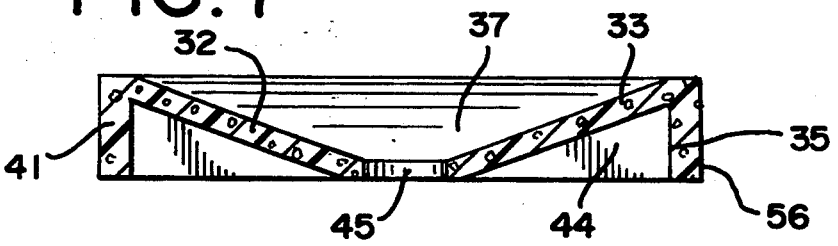
FIG. 7 is a sectional view taken along line 7—7 of FIG. 4.

Referring now to the drawings, and particularly to FIGS. 1 and 2, a bin-type, bulk fluid container embodying features of a first form of the present invention is seen generally at 10. The container 10 is shown resting on a special pallet 11, the construction and use of which will hereinafter be discussed.

The container 10 includes a heavy paper-board carton 12 of standard configuration having a top wall 13, bottom wall 14, front wall 15, rear wall 16, and side walls 17. The container also includes a bulk fluid bag 20 inside the carton 12. In use, as shown the bag 20 is filled with liquid L. An evacuation element in the form of a capped spigot 21 is attached to the bag 20 in the center of its bottom. The spigot 21 projects through orifice 25 in the bottom wall 14 of the carton 12. A filling port and cap 26 are provided on top of the bag 20.

Supporting the bag 20 within the carton 12 is an insert 30 which also embodies features of the invention. The insert 30 is molded in a single body of expanded polyethylene or polypropylene plastic. In the specific form shown, EPERAN, a proprietary expanded polyethylene product of Kaneka Texas Corporation, Houston, Tex., is employed.

Referring now to FIGS. 3–7, the molded plastic insert 30 body is shown in greater detail. It includes a roof-panel 32. The roof panel 32 comprises four panel sections 33, which are identically triangular in shape and inclined to the horizontal. It also includes a border section 36 which surrounds the panel sections 33, 34 and 35 on three sides, and is horizontal. The upper surface 37 of the roof-panel 32 supports the bag 20 in the box 12.

The roof-panel 32 is supported by an upstanding back panel 41, a front panel 42, two side panels 43, a plurality of partition panels 44 extending parallel to the side panels 43, and a cross-brace panel 45 connecting the side panels 43 and partition panels 44. The roof panel sections 33 are each inclined downwardly from their juncture with corresponding wall panels 41 or 43 to where they meet along juncture lines 51 in the upper surface 37 of the roof panel 32.

The juncture lines 51 converge to a cut-out 55 in the center of the roof panel and the front panel 42. At that point 55 the panel surface 37 is approximately 30 mm high. The cut-out 55 forms an opening through the insert 30. The cut-out 55 is centered over the orifice 25 in the bottom wall 14 of the carton 12.

On the upper 37 surface of the roof panel 32, over the border section 36, where the surface is horizontal, the insert 30 illustrated is 175 mm high. The border section 36 is 40 mm wide. From that border section 36, the surface 37 over each of the panel sections 33 is inclined downwardly and toward the other panel section at an angle of 30° to the horizontal. As a result, the juncture lines 51 in the surface 37 converge at an angle of 90° to each other and are inclined 30° to the horizontal.

The surface 37 on the panel 32 is, as has been pointed out, supported on the wall, partition and brace panels 41, 42, 43, 44 and 45. The panel 32 is 30 mm thick. The front and back wall panels 41, 42 are 50 mm thick, as is the brace panel 45. The side wall panels 43 are 54 mm thick. The partition panels 44 are 51 mm thick and spaced 50 mm apart. The cut-out 55 is 100 mm wide. It has been found that these dimensions provide optimum strength with minimum weight and material usage for the plastic used.

Referring again to FIGS. 1 and 2, the bag 20 filled with liquid L is shown supported on the surface 37 of the insert 30. The spigot 21 of the bag 20 protrudes out of the orifice 25 in the bottom wall 14 of the carton 12.

With the bag 20 filled to capacity, which in the illustrated container 10 is 55 gallons, the filler port and cap 26 is positioned immediately adjacent the top 13 of the carton 12. A minimum amount of dunnage (not shown) needs to be employed to fill the little space which remains above the bag 20 and below the removable top wall 13 of the carton 12.

The container 10 filled with liquid L is transported in this way on the loading pallet 11. Containers 10 and pallets 11 may be stacked several layers high when received by the user. Nevertheless, each container can be fully emptied without manipulating the container in any way.

The pallet 11 is designed specifically for use with the bottom unloading container 10. The pallet 11 includes a platform 60 and a base 61 between which is arranged an assembly 62 of pressure treated wood members 65.

As will be seen, the wood members 65 are assembled so as to leave a large passageway 70 running from front to back of the pallet 11, for access to the drain port. This passageway 70 is conventionally protected by a removable door (not shown) during transport.

Using the improved container 10 of the present invention, virtually no liquid remains in the bag 20 after the spigot 21 is opened and the liquid L permitted to gravity drain. The insert 30 which assures this drainage causes all liquid L to flow toward the spigot 21. As a result, only a small amount (measured in pints or quarts rather than gallons) of liquid L will not drain without tipping the container.

Figure 8:
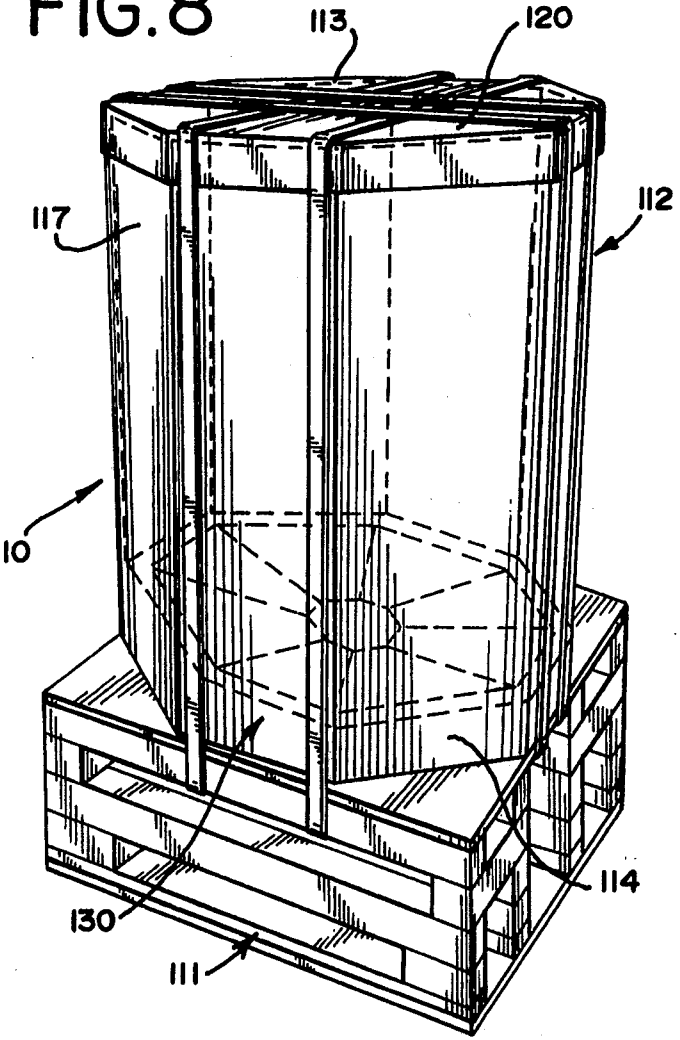
FIG. 8 is a perspective view of a second form of the improved bulk liquid container embodying features of the present invention, with some components shown in phantom lines.

Referring now to FIG. 8, a second form of container embodying features of the present invention is shown at 110. The container 110 is octagonal in plan configuration, rather than square like the container 10 hereinbefore discussed. Once again, it is shown resting on a special pallet 111.

The container 110 includes a heavy paper-board carton 112 of standard, octagonal configuration having a top wall 113, bottom wall 114 and eight identical side walls 117. The container also includes a bulk fluid bag 120 inside the carton 112. In use as shown, the bag 120 is filled with liquid L. An evacuation element in the form of a capped spigot (not shown) is attached to the bag 120 in the center of its bottom. The spigot projects through an orifice (not shown) in the bottom wall 114 of the carton 112. A filling port and cap (not shown) are provided on top of the bag 120.

Supporting the bag 120 within the carton 112 is an insert 130 which also embodies features of the invention. The insert 130 is molded in a single body of expanded polyethylene or polypropylene plastic. In the specific form shown, EPERAN is employed.

Figure 10:
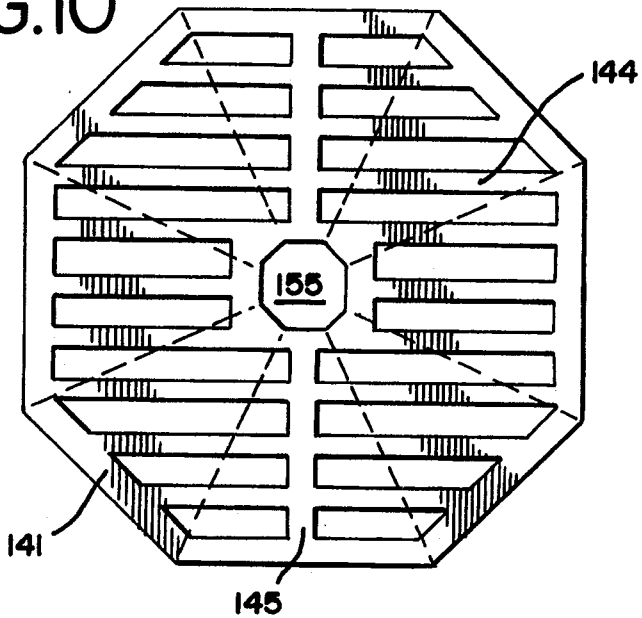
FIG. 10 is a bottom plan view of the insert of FIG. 9.
Figure 9:
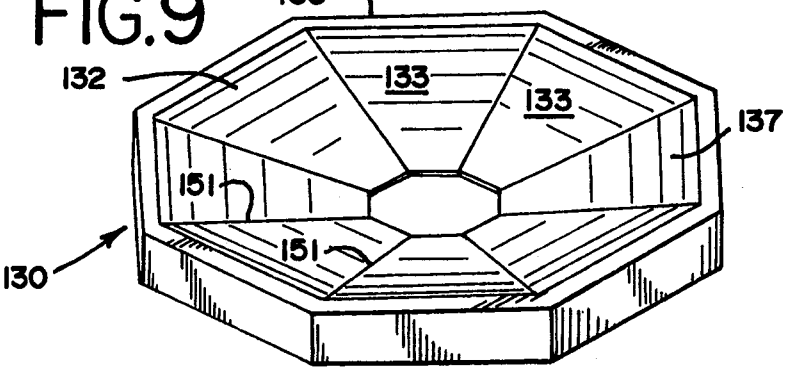
FIG. 9 is a perspective view of the insert in the improved bulk fluid container illustrated in FIG. 8.

Referring now to FIGS. 9 and 10, the molded plastic insert 130 body is shown in greater detail. It includes a roof-panel 132. The roof panel 132 comprises eight panel sections 133, which are identically trapezoidal in shape, and inclined to the horizontal. It also includes a border section 136 which surrounds the panel sections 133 on all eight sides, and is horizontal. The upper surface 137 of the roof-panel 132 supports the bag 120 in the carton 112.

The roof-panel 132, like the panel 32 hereinbefore discussed, is supported by an upstanding side panels 141. Between the side panels 141, a plurality of partition panels 144 extending parallel to each other and a cross-brace panel 145 connecting two side panels 141 and partition panels 144. The roof panel sections 133 are each inclined downwardly from their juncture with corresponding side panels 141 to where they meet along juncture lines 151 in the upper surface 137 of the roof panel 32.

The juncture lines 151 converge to a cut-out 155 in the center of the roof panel 132. At the cut-out 155 the panel surface 37 is approximately 30 mm high. The cut-out 155 forms an opening through the insert 30. The cut-out 155 is centered over the orifice in the bottom wall 114 of the carton 112.

On the upper 137 surface of the roof panel 132, over the border section 136, where the surface is horizontal, the insert 130 illustrated is 175 mm high. The border section 136 is 40 mm wide. From that border section 136, the surface 137 over each of the panel sections 133 is inclined downwardly and toward the other panel section at an angle of 30° to the horizontal. As a result, the juncture lines 151 in the surface 137 converge at an angle of 45° to each other and are inclined 30° to the horizontal.

The surface 137 on the roof panel 132 is, as has been pointed out, supported on the side, partition and brace panels 141, 144 and 45. The panel 132 is 30 mm thick. The side panels 141 are 50 mm thick, as is the brace panel 145. The partition panels 144 are 51 mm thick and spaced 50 mm apart. It has been found that these dimensions provide optimum strength with minimum weight and material usage for the plastic used.

While a preferred embodiment of the invention has been described, it should be understood that the invention is not so limited and modification may be made without departing from the invention. The scope of the invention is defined by the appended claims, and all devices that come within the meaning of the claims, either literally or by equivalence, are intended to be embraced therein.

What is claimed is:

1. In a bin-type, bulk fluid container where the container includes a carton having a bottom wall, side walls and a top wall, with an orifice formed in the bottom wall between said side walls and a bag for holding fluid disposed within said carton and having a drainage element adapted to fit through the orifice, the improvement comprising:

a) a removable insert mounted in said carton underneath said bag;

b) an aperture through said insert in registry with said orifice;

c) said insert having a support surface on which said bag rests;

d) a plurality of inclined partition panels disposed beneath said support surface, said support surface having two side panels and a plurality of inclined partition panels extending parallel to the side panels;

e) said support surface having a shape effective to deform said bag so as to cause liquid in said bag to flow by gravity toward said drainage element.

2. The improvement in a bulk fluid container of claim 1, further characterized in that:

a) said bag support surface includes a surface section inclined downwardly toward said orifice.

3. The improvement in a bulk fluid container of claim 2, further characterized in that:

a) said bag support surface includes a plurality of surface sections each inclined downwardly [at different angles]toward said orifice.

4. The improvement in a bulk fluid container of claim 3, further characterized in that:

a) said insert is formed in one piece of molded plastic.

5. The improvement in a bulk fluid container of claim 3, further characterized in that:

a) said insert is made from a foam polymer selected from the group including polyethylene and polypropylene.

6. The improvement in a bulk fluid container of claim 1, further characterized in that:

a) said carton has an octagonal shape;

b) said insert is octagonal in plan configuration so as to fit complementarily in said carton.

* * * * *

UNITED STATES PATENT AND TRADEMARK OFFICE

CERTIFICATE OF CORRECTION

PATENT NO. : 5,402,915
DATED : April 4, 1995
INVENTOR(S) : Christopher T. Hogan

It is certified that error appears in the above-indentified patent and that said Letters Patent is hereby corrected as shown below:

Column 6, lines 43-44:

In claim 2, lines 8-9, delete "[at different angles]".

Signed and Sealed this

Twentieth Day of February, 1996

*Attest:*

*Attesting Officer*

BRUCE LEHMAN

*Commissioner of Patents and Trademarks*